US006250218B1

(12) United States Patent
Carini et al.

(10) Patent No.: US 6,250,218 B1
(45) Date of Patent: Jun. 26, 2001

(54) PRINT UNIT

(75) Inventors: Franco Carini, Granarolo Dell'Emilia; Mario Spatafora, Bologna, both of (IT)

(73) Assignee: G.D. S.p.A., Bologna (IT)

( * ) Notice: Subject to any disclaimer, the term of this patent is extended or adjusted under 35 U.S.C. 154(b) by 0 days.

(21) Appl. No.: 09/343,475

(22) Filed: Jun. 30, 1999

(30) Foreign Application Priority Data

Jul. 8, 1998 (IT) ..... BO98A0421

(51) Int. Cl.[7] ..... B41F 17/00
(52) U.S. Cl. ..... 101/37; 400/649
(58) Field of Search ..... 101/37; 400/649

(56) References Cited

U.S. PATENT DOCUMENTS 3,995,730 * 12/1976 Kwan et al. ..... 197/127
4,098,389 * 7/1978 Kwan ..... 400/649
5,002,267 * 3/1991 Brecy ..... 271/9
5,048,986 * 9/1991 Czesnik et al. .

FOREIGN PATENT DOCUMENTS

961245 * 5/1950 (FR) .

* cited by examiner

*Primary Examiner*—John S. Hilten
*Assistant Examiner*—Charles H. Nolan, Jr.
(74) *Attorney, Agent, or Firm*—Pillsbury Winthrop LLP

(57) ABSTRACT

The invention relates to a print unit for a packaging machine, in which a cavity, equipped with an armature made of ferromagnetic material and supporting, in operation, a blank to be printed, is mobile in front of a fixed electromagnet, which can be activated so as to attract the armature against a fixed print head, thus clamping the blank between the armature and the print head.

12 Claims, 2 Drawing Sheets

PRINT UNIT

BACKGROUND OF THE INVENTION

The present invention relates to a print unit. In particular, the invention relates to a print unit suitable for use in cigarette packaging machines, to which the following text refers, although without limiting the scope of the invention, for printing a code on wrapping material blanks used in the packaging machine.

Known cigarette packaging machines normally comprise a print unit for printing a code on the blanks, allowing identification, for example, of the date and/or place of production of the relative packet.

In the above-mentioned packaging machines, the print unit in turn comprises a seat designed to hold a blank and mounted on a rotary wheel which moves the blank forward along a path which passes through a print station. The print station houses an actuator which moves a print head away from and towards the seat, so as to print the above-mentioned code on a blank held in the seat.

The above-described print unit is normally equipped with a deformable elastic element, which is inserted between the above-mentioned actuator and the print head, or between the seat and the wheel, and can be adjusted to calibrate the force with which the print head acts upon the blank.

In operation, the above-described print unit subjects the wheel shaft supports to relatively high levels of stress, particularly in modern packaging machines, which have very high operating speeds (over 500 packets per minute). Since they must stand such stress, the shaft supports and corresponding seats must be very strong and are, therefore, expensive.

Moreover, in the above-mentioned print unit, it is very difficult to precisely calibrate the force with which the print head acts upon the blank, since said force depends on the elastic characteristics of the deformable element, on the reciprocal position of the print head and the seat, and on the actuator travel.

The aim of the present invention is to provide a print unit which has none of the above-mentioned disadvantages and, at the same time, is simple and economical to produce.

SUMMARY OF THE INVENTION

Accordingly, the invention provides a print head comprising a print head housed in a print station for printing a graphic symbol on a sheet; an electromagnet housed in the print station; an armature made of a ferromagnetic material which moves away from and towards the print head due to the action of a magnetic field produced by the electromagnet; feed means for feeding the sheet to the print station in a position between the armature and the print head; and control means designed to activate the electromagnet, so as to attract the armature against the print head.

BRIEF DESCRIPTION OF THE DRAWINGS

The invention will now be described with reference to the accompanying drawings, which illustrate an embodiment of the invention, without limiting the scope of its application; and in which.

DESCRIPTION OF THE PREFERRED EMBODIMENTS

Figure 1:
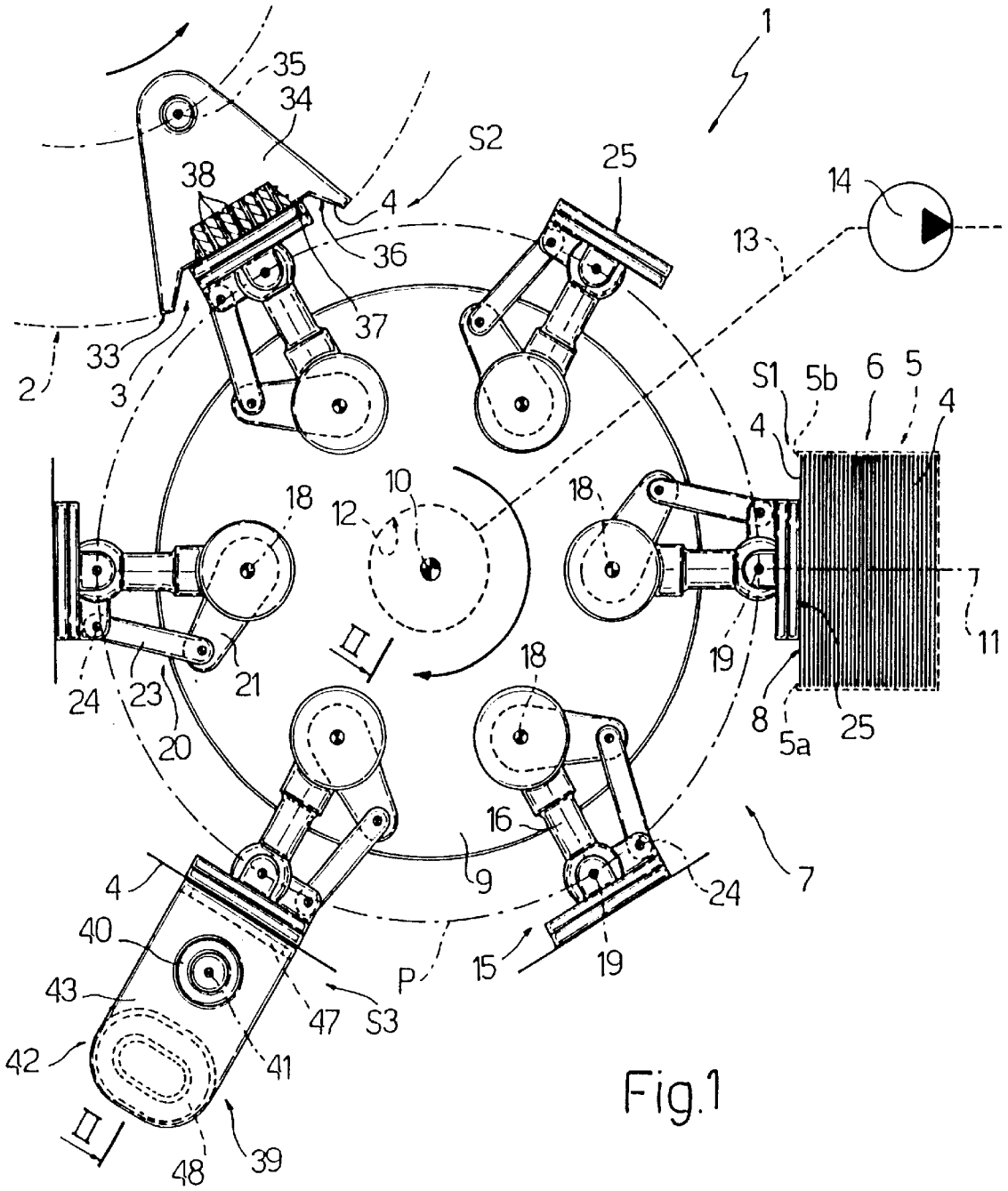
FIG. 1 is a side elevation view, with some parts cut away to better illustrate others, of a preferred embodiment of the unit according to the present invention.

With reference to the accompanying drawings, in FIG. 1 the numeral 1 indicates as a whole a continuous packaging machine comprising a motor-driven wrapping wheel 2, designed to turn with continuous motion (counterclockwise in FIG. 1) about its axis (not illustrated) perpendicular to the plane in FIG. 1. The wheel 2 has a plurality of evenly distributed peripheral seats 3 (only one of which is illustrated), designed to receive a succession of ready-folded blanks 4 made of cardboard or a similar material. The machine 1 also comprises a magazine 5 for a stack 6 of blanks 4, and a suction pick-up unit 7, located between a pick-up station S1 which is positioned at an open base 8 of the magazine 5, and a feed station S2 which is positioned at the wrapping wheel 2, to take the blanks 4 from the open base 8 and feed them in succession to the seats 3.

The pick-up unit 7 comprises a motor-driven wheel 9 which turns continuously, and clockwise in FIG. 1, about its fixed central axis 10, parallel with the axis (not illustrated) of the wheel 2, and perpendicular to a longitudinal axis 11 of the magazine 5. The wheel 9 has an inner chamber 12 (only partially illustrated), pneumatically connected by a pipe 13 to a suction pump 14 designed to create a vacuum in the inner chamber 12, so that the pressure in the inner chamber is lower than the outside atmospheric pressure.

The chamber 12 is connected (in a known way, not illustrated) to a plurality of pneumatic pick-up heads 15 supported by the wheel 9 and evenly distributed about the axis 10. The pick-up heads 15 are connected to the wheel 9 by arms 16, each hinged to the wheel 9 by a pin 17 (illustrated in FIG. 2) in such a way that it oscillates, relative to the wheel 9, about an axis 18 parallel with the axis 10. Each pick-up head 15 is, in turn, hinged to the relative arm 16 in such a way that it oscillates, relative to the arm 16, about an axis 19 parallel with the axis 10.

The angle of each arm 16 about the axis 18 is controlled by a cam control device (of the known type and not illustrated) housed in the wheel 9.

The angle of each pick-up head 15 about the axis 19 is controlled by another cam control device (of the known type and not illustrated) housed in the wheel 9 and mechanically connected to the pick-up head 15 by a lever mechanism 20 comprising a lever 21 hinged to the wheel 9 in such a way that it oscillates about the axis 18 by a hollow pin 22 (illustrated in FIG. 2) which houses the relative pin 17, and a connecting rod 23, one end of which is hinged to the lever 21, the other end being hinged to the pick-up head 15 in such a way that it oscillates, relative to the pick-up head 15, about an axis 24 parallel with the axis 10.

Figure 2:
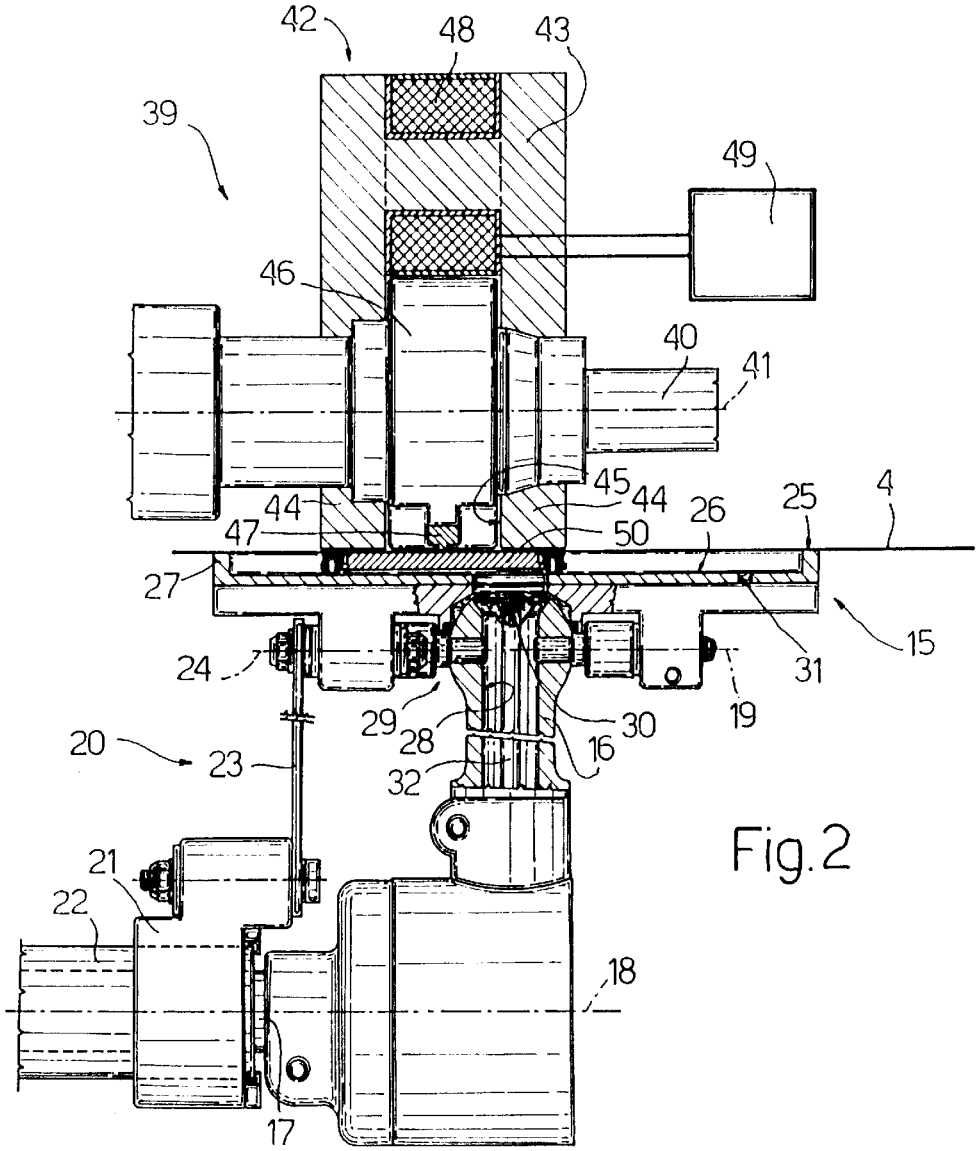
FIG. 2 is a scaled-up detail from FIG. 1, in cross-section according to line II—II in FIG. 1.

As is better illustrated in FIG. 2, each head 15 substantially has the shape of a plate, one side of which is connected to the relative arm 16, and the other side of which is limited by a pick-up surface 25, in which a cavity 26 is defined, delimited by a ring-shaped edge 27 and connected to the chamber 12 by a pipe 28 made along the arm 16.

In the embodiment illustrated, the pick-up surface 25 is substantially defined by the upper surface of the edge 27.

Inside each pipe 28, at the joint 29 connecting the pipe 28 to the relative head 15, there is a valve 30, designed to open and close the pipe 28, so that it is communication with or cut off from the cavity 26. Each head 15 also has a through-hole 31, which provides permanent communication between the cavity 26 and the outside.

Each valve 30 is of the known type with mechanical control, and is controlled by a rod 32 designed so that it can be moved axially in a direction that is radial to the axis 10 by a cam driver device (of the known type and not illustrated) housed in the wheel 9, between an open position (illustrated in FIG. 2) in which the cavity 26 is pneumatically connected to the pipe 28 and, therefore, to the chamber 12, and a closed position (not illustrated) in which the cavity 26 is pneumatically isolated from the pipe 28 and, therefore, the chamber 12.

In order to hold a blank 4 in contact with the pick-up surface 25 of a head 15, the surface 25 is substantially brought into contact with the blank 4, which seals the cavity 26 and, together with the cavity 26, forms a vacuum chamber, in which a vacuum is created (relative to the atmospheric pressure), by opening the corresponding valve 30 and, therefore, putting the vacuum chamber in communication with the chamber 12, in which the pump 14 constantly maintains a vacuum.

The head loss caused by the presence of the through-hole 31 permanently connected to the outside does not create particular problems, since the pump 14 is able to compensate even high levels of head loss, such as those induced by the through-hole 31.

In order to release the blank 4, the atmospheric pressure in the vacuum chamber is automatically restored, thanks to the presence of the hole 31, by simply closing the valve 30.

As illustrated in FIG. 1, each seat 3 is made on an outer surface 33 of a head 34 opposite an inner portion of the head 34 connected to the wheel 2 in such a way that it oscillates, relative to the wheel 2, about an axis 35 parallel with the axis 10, controlled by a cam-rocker switch control device (of the known type and not illustrated). Each seat 3 has two lateral surfaces 36, which are angled towards one another and towards a lower surface 37, in which there are holes 38 for communication with a known type of suction device, not illustrated.

The continuous rotation of the wheel 9 about the axis 10 causes each head 15 to move forwards along a closed path P, substantially circular and extending about the axis 10, and through the pick-up station S1, in which the head 15 picks up a blank 4 from the open base 8 of the magazine 5, through a print station S3, in which a print unit 39 prints a code (not illustrated) on the blank 4, and through the feed station S2, in which the head 15 feeds the blank 4 to a corresponding seat 3 of the wrapping wheel 2.

The above-mentioned code (not illustrated) is normally alphanumeric, or a bar code, and usually indicates the date and/or place of production of the packet.

As illustrated in FIG. 2, the print unit 39 comprises a support pin 40, mounted on the machine 1 in such a way that it oscillates about an axis 41 parallel with the axis 10, under the thrust of a cam actuator device (of the known type and not illustrated), and rigidly supporting an electromagnet 42, which has a core 43 made of ferromagnetic material with a pair of opposite pole shoes 44, between which there is a chamber 45 through which the pin 40 passes.

In the chamber 45 and, therefore, between the pole shoes 44, is a print device 46 which is rigidly supported by the pin 40 and has a print head 47 designed to print the code on a blank 4.

The electromagnet 42 also comprises a coil 48 designed to produce a magnetic field along the core 43 when an electric current with adjustable intensity is passed through it, said current generated by a control device 49 of the known type electrically connected to the coil 48.

Figure 3:
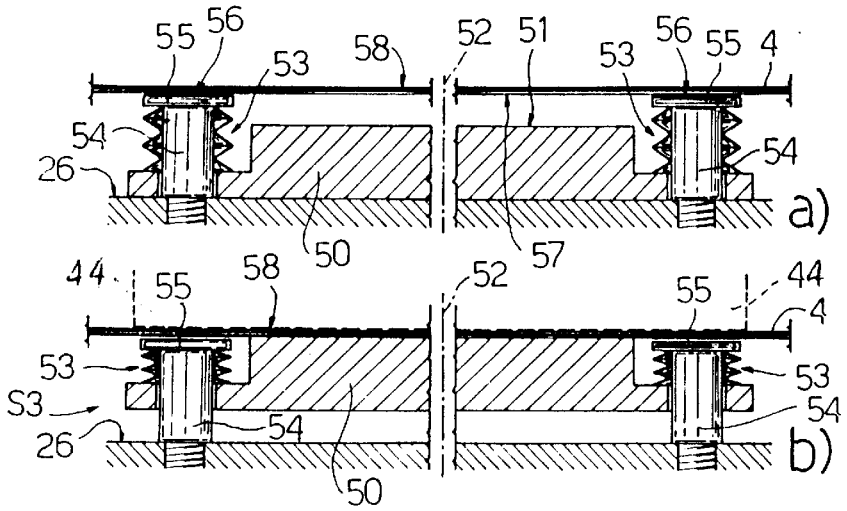
FIG. 3 is a scaled-up detail from FIG. 2.

As illustrated in FIG. 3, each pick-up head 15 comprises an armature 50 made of ferromagnetic material, which has a flat outer surface 51 designed to support a blank 4 and is mounted in such a way that it is mobile in the cavity 26, moving along a direction 52 perpendicular to the axis 19 against the action of a pair of springs 53, each of which is wrapped around a fixed pin 54, along which the armature 50 can slide.

Each spring 53 is compressed between the armature 50 and an upper head 55 of the relative pin 54, so that the armature 50 is normally held in a home position (illustrated in FIG. 3*a*), in which the surface 51 is at a given distance other than zero from a relative blank 4. An upper surface 56 of each head 55 constitutes a base upon which a blank 4 rests, the blank held by the corresponding pick-up head 15.

The operation of the machine 1 is described below with reference to a single pick-up head 15 and starting from a moment in which the pick-up head 15 has released a blank 4 into a seat 3 at the feed station S2 and moves, under the thrust of the wheel 9 and along the path P, towards the pick-up station S1, to pick up another blank 4.

During the transit between the feed station S2 and the pick-up station S1, the valve 30 of the head 15 is kept in the closed position and the cam control devices (of the known type and not illustrated) impart to the arm 16 an early oscillation (clockwise in FIG. 1) about the axis 18, which continues until the head 15, moving along the path P, reaches a position close to the feed station S1.

When the head 15 moves close to the station S1, the cam control devices (of the known type and not illustrated) impart to the arm 16 a delay oscillation (counterclockwise in FIG. 1) about the axis 18 and a simultaneous oscillation (clockwise in FIG. 1) of the head 15 about the axis 19, so that the head 15 is substantially stopped in a position opposite the base 8 of the magazine 5 and, at the same time, the head 15 is pushed outwards in a radial direction until it adheres to the blank 4 which is in contact with the base 8, and the head 15 is, therefore, pushed in the direction of the axis 11 towards the inside of the magazine 5, exerting a given pressure on the blank 4.

As the head 15 moves forwards inside the magazine 5 in the direction of the axis 11, suction is activated through the cavity 26, bringing the valve 30 into the open position, to hold the blank 4 in contact with the surface 25.

When the blank 4 adheres to the surface 25, an oscillation (clockwise in FIG. 1) about the axis 19 is imparted to the head 15, allowing a first edge of the blank 4, the lower edge in FIG. 1, to be deformed and clear a tooth 5a delimiting the base 8, then removal of a second edge (the upper edge in FIG. 1) of the blank 4 from under a tooth 5*b* delimiting the base 8, thus completing extraction of the blank 4 from the base 8.

At this point, the cam control devices (of the known type and not illustrated) interrupt the delay oscillation of the arm 16 about the axis 18 and, due to the rotation of the wheel 9, the head 15 leaves the pick-up station S1, in which it picked up the blank 4, and goes to the print station S3.

During the transit between the pick-up station S1 and the print station S3, the cam control devices (of the known type and not illustrated) impart to the arm 16 an early oscillation (clockwise in FIG. 1) about the axis 18, which continues until the head 15, moving along the path P, reaches a position close to the print station S3.

When the head 15 moves close to the print station S3, the cam control devices (of the known type and not illustrated) impart to the arm 16 a delay oscillation (counterclockwise in FIG. 1) about the axis 18 and a simultaneous oscillation (clockwise in FIG. 1) of the head 15 about the axis 19, so that the head 15 is substantially stopped, for a given interval, in a position opposite the print unit 39 (as illustrated in FIG. 2) which, in turn, and for the same purpose, completes a corresponding oscillation about the axis 41.

In accordance with another embodiment, not illustrated, the pin 40 is a fixed pin and the unit 39 does not oscillate about the axis 41.

In the print station S3 and during the above-mentioned interval, the blank 4 is in a position (illustrated in FIG. 2) between the armature 50 and the print head 47. The control device 49 then supplies the coil 48 with a current with preset intensity, to generate at the core 43 a magnetic field which attracts the armature 50 towards the pole shoes 44 against the action of the springs 53; the consequent movement of the armature 50 towards the pole shoes 44 brings the surface 51 of the armature 50 into contact with a corresponding inner surface 57 of the blank 4, bringing an outer surface 58 of the blank 4 into contact with the print head 47 with a preset force, depending on the elastic force generated by the springs 53 and the intensity of the magnetic field, which, in turn, depends on the intensity of the electrical current circulating in the coil 48.

Then, when the magnetic field is interrupted by interrupting the current passing through the coil 48, the armature 50 returns, due to the action of the springs 53, to the home position (illustrated in FIG. 3*a*) and the cam control devices (of the known type and not illustrated) interrupt the delay oscillation of the arm 16 about the axis 18 and, due to the rotation of the wheel 9, the head 15 leaves the print station S3 and goes to the feed station S2.

During the transit between the print station S3 and the feed station S2, the cam control devices (of the known type and not illustrated) impart to the arm 16 an early oscillation (clockwise in FIG. 1) about the axis 18, which continues until the head 15, moving along the path P, reaches a position close to the feed station S2.

When the head 15 moves close to the station S2, the cam control devices (of the known type and not illustrated) impart to the arm 16 a delay oscillation (counterclockwise in FIG. 1) about the axis 18 and a simultaneous oscillation (clockwise in FIG. 1) of the head 15 about the axis 19, so that the head 15 is substantially stopped in a position opposite the corresponding seat 3 of the wrapping wheel 2 and, at the same time, the head 15 is pushed outwards until the pick-up surface 25 substantially adheres to the lower surface 37 of the seat 3.

When the pick-up head 15 is in the feed station S2, the head 34 in which the seat 3 is made also oscillates about the axis 35, to keep the pick-up surface 25 and the lower surface 37 opposite one another and substantially parallel.

During the substantially radial movement of the surface 25 towards the lower surface 37, the suction through the cavity 26 is interrupted, bringing the valve 30 into the closed position and, at the same time, suction through the holes 38 is activated, so that the blank 4 is left in the seat 3 and is pneumatically held in the seat 3.

At this point, the cam control devices (of the known type and not illustrated) interrupt the delay oscillation of the arm 16 about the axis 18 and, due to the rotation of the wheel 9, the head 15 leaves the feed station S2 and goes to the pick-up station S1. The above-mentioned operations are repeated cyclically.

Obviously, the above-mentioned oscillations (clockwise in FIG. 1) of the head 15 about the axis 19 during the steps in which the head 15 moves towards the stations S1, S2, S3, are followed by return oscillations (counterclockwise in FIG. 1) about the axis 19 during the subsequent steps in which the head moves away from the stations S1, S2, S3.

As illustrated in FIG. 1, insertion of the head 15 in the seat 3 allows the blank 4 to be folded into a U-shape along its pre-folded lines (of the known type and not illustrated) as the blank 4 is fed to the seat 3.

The above description clearly indicates that, during the printing operations, the shaft (not illustrated) of the wheel 9, the pins 17 and hinges at 19 are not subjected to any impact generated by the contact between the armature 50 and the print head 47, since such impacts are absorbed by the pin 40. Moreover, the force with which each blank 4 makes contact with the print head 47 can be regulated, even during operation, in a simple, rapid, precise fashion, by simply adjusting the intensity of the current supplied to the coil 48.

What is claimed is:

1. A print unit comprising:

a print head housed in a print station for printing a graphic symbol on a sheet, including an electromagnet in the print station;

an armature made of ferromagnetic material and mobile away from and towards the print head under the action of a magnetic field produced by the electromagnet;

feed means for feeding the sheet from a pick-up station to the print station in a position between the armature and the print head, said armature being supported by said feed means; and control means, being designed to activate the electromagnet so as to attract the armature against the print head.

2. The unit according to claim 1, wherein the print head is integral with the electromagnet.

3. The unit according to claim 1, wherein the electromagnet comprises a pair of pole shoes, said shoes, in operation, being opposite the armature; the print head being positioned between the pole shoes.

4. The unit according to claim 1, wherein the electromagnet comprises a coil; the control means comprising a generator designed to cause an electrical current with adjustable intensity to circulate in the coil.

5. The unit according to claim 1, comprising elastic means, the armature being mobile towards the print head against the action of the elastic means, and the print head being mounted in a fixed position.

6. The unit according to claim 5, wherein the elastic means comprise a pair of springs.

7. The unit according to claim 1, wherein the feed means comprising conveyor extending through the print station and, in turn, comprising a pick-up head which picks up a sheet; the armature being mounted on the pick-up head in such a way that it is mobile.

8. The unit according to claim 7, wherein the feed means comprise at least one cavity made in the pick-up head, and suction means for creating a vacuum inside the cavity; the suction means comprising a pipe communicating with the cavity, a control valve positioned along the pipe, and a suction pump connected to the pipe; the valve being located between the pump and the cavity and close to the cavity; and at least one through-hole, being made in the head so that the cavity is permanently in communication with the outside.

9. The unit according to claim 8, wherein the armature is mounted in the cavity in such a way that it is mobile.

10. The unit according to claim 7, wherein the conveyor comprises a wheel which rotates about a first, fixed, central axis; there being jointed connecting means between the pick-up head and the wheel.

11. The unit according to claim 10, wherein the jointed connecting means comprise an arm, being hinged to the wheel in such a way that it oscillates, relative to the wheel, about a second axis, the latter being parallel with the first axis; the pick-up head being hinged to the arm in such a way that it oscillates, relative to the arm, about a third axis, the latter being parallel with the first axis.

12. The unit according to claim 11, wherein the print head and the electromagnet are designed to oscillate about a fourth axis, the latter being parallel with the first axis.

* * * * *